US010626888B2

(12) United States Patent
Fletcher et al.

(10) Patent No.: US 10,626,888 B2
(45) Date of Patent: Apr. 21, 2020

(54) DUAL VENTURI DEVICE

(71) Applicants: David E. Fletcher, Flint, MI (US); Brian M. Graichen, Leonard, MI (US); Keith Hampton, Ann Arbor, MI (US)

(72) Inventors: David E. Fletcher, Flint, MI (US); Brian M. Graichen, Leonard, MI (US); Keith Hampton, Ann Arbor, MI (US)

(73) Assignee: Dayco IP Holdings, LLC, Troy, MI (US)

( * ) Notice: Subject to any disclaimer, the term of this patent is extended or adjusted under 35 U.S.C. 154(b) by 423 days.

(21) Appl. No.: 14/796,447

(22) Filed: Jul. 10, 2015

(65) Prior Publication Data

US 2016/0010661 A1 Jan. 14, 2016

Related U.S. Application Data

(60) Provisional application No. 62/022,839, filed on Jul. 10, 2014.

(51) Int. Cl.
*F04F 5/44* (2006.01)
*F04F 5/14* (2006.01)
(Continued)

(52) U.S. Cl.
CPC ..... *F04F 5/44* (2013.01); *F04F 5/14* (2013.01); *F04F 5/20* (2013.01); *F04F 5/46* (2013.01); *F04F 5/467* (2013.01)

(58) Field of Classification Search
CPC ..... F04F 5/14; F04F 5/20; F04F 5/44; F04F 5/46; F04F 5/54; F04D 9/06
(Continued)

(56) References Cited

U.S. PATENT DOCUMENTS 1,845,969 A 2/1932 Hueber
2,183,561 A 12/1939 Hamblin
(Continued)

FOREIGN PATENT DOCUMENTS

CN 2400655 10/2000
CN 1724298 A 1/2006
(Continued)

OTHER PUBLICATIONS

English Translation of JP 2007-327453 obtained Nov. 29, 2017.*
(Continued)

*Primary Examiner* — Dominick L Plakkoottam
*Assistant Examiner* — Connor J Tremarche
(74) *Attorney, Agent, or Firm* — FisherBroyles, LLP; Susan M. Oiler

(57) ABSTRACT

Venturi devices and systems incorporating the same are disclosed. The Venturi devices include a lower body defining a passageway having a motive section and a discharge section spaced a distance apart from one another to define a first Venturi gap and a second Venturi gap downstream of the first Venturi gap at a position that divides the discharge section into a first portion between the first and second Venturi gaps and a second portion leading away from the second Venturi gap, and include an upper body defining a suction passageway in fluid communication with both the first and second Venturi gaps. The motive section and the discharge section converge toward the first Venturi gap.

23 Claims, 6 Drawing Sheets

(51) Int. Cl.
*F04F 5/20* (2006.01)
*F04F 5/46* (2006.01)

(58) Field of Classification Search
USPC ..... 417/174, 170
See application file for complete search history.

(56) References Cited

U.S. PATENT DOCUMENTS

| | | | | |
|---|---|---|---|---|
| 2,396,290 | A * | 3/1946 | Schwarz | F04F 5/467 417/170 |
| 2,399,249 | A * | 4/1946 | Perignat | F04F 5/48 417/170 |
| 2,449,683 | A | 9/1948 | Akernan et al. | |
| 2,512,479 | A | 6/1950 | Callejo | |
| 3,145,724 | A | 8/1964 | Pelzer | |
| 3,234,932 | A | 2/1966 | Bird et al. | |
| 3,430,437 | A | 3/1969 | Saussele et al. | |
| 3,581,850 | A | 6/1971 | Jaitl | |
| 3,754,841 | A | 8/1973 | Grabb et al. | |
| 3,826,281 | A | 7/1974 | Clark | |
| 4,211,200 | A | 7/1980 | Rocchio et al. | |
| 4,308,138 | A | 12/1981 | Woltman | |
| 4,354,492 | A | 10/1982 | McPhee | |
| 4,499,034 | A | 2/1985 | McAllister | |
| 4,519,423 | A | 5/1985 | Ho et al. | |
| 4,554,786 | A | 11/1985 | Takeuchi et al. | |
| 4,556,086 | A | 12/1985 | Raines | |
| 4,634,559 | A | 1/1987 | Eckert | |
| 4,683,916 | A | 8/1987 | Raines | |
| 4,759,691 | A | 7/1988 | Kroupa | |
| 4,880,358 | A | 11/1989 | Lasto | |
| 4,893,654 | A | 1/1990 | Feuz | |
| 4,951,708 | A | 8/1990 | Miller | |
| 5,005,550 | A | 4/1991 | Bugin, Jr. et al. | |
| 5,108,266 | A | 4/1992 | Hewitt | |
| 5,188,141 | A | 2/1993 | Cook et al. | |
| 5,291,916 | A | 3/1994 | Kloosterman et al. | |
| 5,584,668 | A | 12/1996 | Volkmann | |
| 5,816,446 | A | 10/1998 | Steindorf et al. | |
| 6,035,881 | A | 3/2000 | Emmerich et al. | |
| RE37,090 | E | 3/2001 | Kloosterman et al. | |
| 6,220,271 | B1 | 4/2001 | Emmerich et al. | |
| 6,308,731 | B1 | 10/2001 | Kawasaki | |
| 6,394,760 | B1 | 5/2002 | Tell | |
| 6,619,322 | B1 * | 9/2003 | Wojciechowski | F16K 1/34 137/625.33 |
| 7,029,103 | B2 | 4/2006 | Iida | |
| 7,353,812 | B1 | 4/2008 | Gosdzinski et al. | |
| 7,610,140 | B2 | 10/2009 | Hirooka | |
| 7,628,170 | B2 | 12/2009 | Kok-Hiong et al. | |
| 7,722,132 | B2 | 5/2010 | Carlsson | |
| 8,517,056 | B2 | 8/2013 | Cullin | |
| 9,827,963 | B2 | 11/2017 | Fletcher et al. | |
| 2002/0002997 | A1 | 1/2002 | Steinruck et al. | |
| 2004/0036185 | A1 | 2/2004 | Garcia | |
| 2004/0113288 | A1 | 6/2004 | Korzeniowski | |
| 2004/0169599 | A1 * | 9/2004 | Mathiasson | H01Q 17/00 342/1 |
| 2005/0061378 | A1 | 3/2005 | Foret | |
| 2005/0121084 | A1 | 6/2005 | Andersson | |
| 2006/0016477 | A1 * | 1/2006 | Zaparackas | B60T 13/52 137/112 |
| 2007/0044848 | A1 | 3/2007 | Norman | |
| 2007/0152355 | A1 | 7/2007 | Hartley | |
| 2008/0007113 | A1 | 1/2008 | Choi | |
| 2008/0121480 | A1 * | 5/2008 | Kawamori | B60T 13/52 188/356 |
| 2008/0145238 | A1 | 6/2008 | Shibayama et al. | |
| 2011/0123359 | A1 * | 5/2011 | Schaaf | F04F 5/22 417/174 |
| 2011/0132311 | A1 | 6/2011 | Pursifull et al. | |
| 2011/0186151 | A1 | 8/2011 | Sparazynski | |
| 2012/0024249 | A1 | 2/2012 | Fuhrmann et al. | |
| 2013/0139911 | A1 | 6/2013 | Wilson et al. | |
| 2013/0213510 | A1 * | 8/2013 | Burnham | F16K 15/14 137/888 |
| 2013/0233276 | A1 | 9/2013 | Pursifull et al. | |
| 2013/0233287 | A1 | 9/2013 | Leone | |
| 2013/0340732 | A1 | 12/2013 | Pursifull et al. | |
| 2014/0014080 | A1 | 1/2014 | Beshay et al. | |
| 2014/0165962 | A1 | 6/2014 | Pursifull | |
| 2014/0197345 | A1 | 7/2014 | Graichen et al. | |
| 2014/0360607 | A1 * | 12/2014 | Fletcher | B60T 17/02 137/888 |
| 2015/0114350 | A1 | 4/2015 | Pursifull | |

FOREIGN PATENT DOCUMENTS

| | | | |
|---|---|---|---|
| CN | 201109426 | | 9/2008 |
| CN | 201377408 | Y | 1/2010 |
| CN | 201907500 | | 7/2011 |
| CN | 103407441 | | 11/2013 |
| CN | 203394893 | U | 1/2014 |
| CN | 203485907 | U | 3/2014 |
| DE | 3809837 | A1 | 10/1988 |
| DE | 4310761 | | 10/1994 |
| EP | 0442582 | A1 | 8/1991 |
| GB | 2110344 | A | 6/1983 |
| GB | 2129516 | | 5/1984 |
| GB | 2171762 | | 9/1986 |
| JP | H01-111878 | U | 7/1989 |
| JP | 2001-295800 | | 10/2001 |
| JP | 2007-327453 | | 12/2007 |
| JP | 2007327453 | A * | 12/2007 |
| JP | 2009168134 | | 7/2009 |
| WO | 2007/050011 | A1 | 5/2007 |
| WO | 2007/078077 | | 7/2007 |
| WO | 2008/014306 | A2 | 1/2008 |
| WO | 2010054900 | A1 | 5/2010 |

OTHER PUBLICATIONS

U.S. Advisory Action; U.S. Appl. No. 14/509,612; (dated Sep. 1, 2016).

U.S. Notice of Allowance; U.S. Appl. No. 14/509,612; (dated Oct. 17, 2016).

PCT, International Search Report and Written Opinion, PCT/US2014/041250 (dated Oct. 27, 2014).

PCT, International Search Report and Written Opinion, PCT/US2014/059672 (dated Jan. 9, 2015).

PCT, International Search Report and Written Opinion, PCT/US2015/012018 (dated May 8, 2015).

PCT, International Search Report and Written Opinion, PCT/US2015/024195 (dated Jul. 24, 2015).

PCT, International Search Report and Written Opinion, PCT/US2015/033079 (dated Aug. 21, 2015).

PCT, International Search Report and Written Opinion, PCT/US2015/039950 (dated Oct. 5, 2015).

U.S. Final Office Action; U.S. Appl. No. 14/509,612; (dated Jun. 22, 2016).

CN, Search Report with English translation; Chinese Patent Application No. 201480001422.9; (dated Jul. 20, 2016).

CN, Office Action with English translation; Chinese Patent Application No. 201480001422.9; (dated Aug. 1, 2016).

U.S. Final Office Action; U.S. Appl. No. 14/600,598; (dated Aug. 19, 2016).

U.S. Notice of Allowance; U.S. Appl. No. 14/600,598; (dated Nov. 10, 2016).

U.S. Non-Final Office Action; U.S. Appl. No. 14/294,727; (dated Oct. 8, 2015).

U.S. Final Office Action; U.S. Appl. No. 14/294,727; (dated Apr. 22, 2016).

CN, Office Action and Search Report with English translation; Chinese Patent Application No. 201410413220.7; (dated Nov. 14, 2016).

CN, Office Action with English translation; Chinese Patent Application No. 201480001422.9; 19 pages (dated Feb. 16, 2017).

(56) References Cited

OTHER PUBLICATIONS

EP, Supplementary European Search Report; Patent Application No. 14811266.7; 5 pages (dated Apr. 5, 2017).
CN, First Office Action and Search Report with English translation; Patent Application No. 2015800003002; 11 pages (dated Apr. 6, 2017).
EP, Extended European Search Report; Patent Application No. 14852220.4, Applicant Dayco IP Holdings, LLC, 6 pages (dated May 10, 2017).
CN, Office Action with English translation; Chinese Patent Application No. 2015800050465, Applicant Dayco IP Holdings, LLC, 7 pages (dated Jul. 4, 2017).
CN, Search Report with English translation; Chinese Patent Application No. 2015800050465, Applicant Dayco IP Holdings, LLC, 4 pages (dated Jul. 4, 2017).
PCT, International Search Report and Written Opinion, PCT/US2015/043911 (dated Nov. 6, 2015).
EP, Supplemental Search Report: European Application No. 15818552.0 (dated Mar. 7, 2018).
CN, Third Office Action English Translation; Chinese Application No. 201410413220.7 (dated Jan. 17, 2018).
CN Search Report with English Translation, Chinese Patent Application No. 201580042186X dated Oct. 31, 2017 (3 pages).
CN, Second Office Action with English Translation, Chinese Application No. 201410413220.7 dated Jul. 18, 2017 (5 pages).
CN, Third Office Action, Supplemental Search Report with English Translation, Chinese Application No. 201410413220.7 dated Jan. 3, 2018 (6 pages).
EP, Search Report, Application No. 15737914.0 filed Jul. 7, 2017 (8 pages).
JP, Non-Final Office Action with English Translation; Japanese Application No. 2016-519556 (dated May 18, 2018).
EP, Supplemental Search Report; European Application No. 15830300.8 (dated May 29, 0218).
U.S. First Office Action, U.S. Appl. No. 15/791,561 (dated Jul. 26, 2018).
JP, First Office Action with English Translation; Japanese Application No. 2016-521267 (dated Sep. 11, 2018).
JP, Office Action with English Translation; Japanese Application No. 2017-506350 (dated Sep. 12, 2018).
JP, Second Office Action with English Translation; Japanese Application No. 2017-506350 (dated Feb. 22, 2018).
JP, First Office Action with English Translation; Japanese Application No. 2017-500969 (dated Jun. 20, 2019) (12 Pages).
JP, Second Office Action with English Translation; Japanese Application No. 2016-521267 (dated Apr. 5, 2019) (8 Pages).

* cited by examiner

DUAL VENTURI DEVICE

RELATED APPLICATIONS

This application claims the benefit of U.S. Provisional Application No. 62/022,839, filed Jul. 10, 2014, the entirety of which is incorporated herein by reference.

TECHNICAL FIELD

This application relates to vacuum creation by a Venturi device and, more particularly, to a Venturi device having two Venturi gaps. In the exemplary embodiments herein, the Venturi device is connected to a high pressure source (a pressure higher than atmospheric pressure) as its motive source and is referred to as an ejector.

BACKGROUND

In some vehicles, vacuum is used to operate or assist in the operation of various devices. For example, vacuum may be used to assist a driver applying vehicle brakes, turbocharger operation, fuel vapor purging, heating and ventilation system actuation, and driveline component actuation. If the vehicle does not produce vacuum naturally, such as from the intake manifold, then a separate vacuum source is required to operate such devices. While an aspirator or an ejector can produce vacuum when supplied with either boost or manifold vacuum, the depth of vacuum produced will be a function of the difference in pressure between the pressure applied to the motive port and the pressure applied to the discharge port. However, in boosted engines where intake manifold pressures are often at pressures greater than atmospheric pressure, intake manifold vacuum may be replaced or augmented with vacuum from an ejector. An ejector, as used herein, is a converging, diverging nozzle assembly connected to a pressure source above atmospheric pressure. By passing pressurized air through the ejector, a low pressure region may be created within the ejector so that air can be drawn from a vacuum reservoir or may directly act on a device requiring vacuum, thereby reducing pressure within the vacuum reservoir or device requiring vacuum.

Typical ejectors cannot produce a suction pressure below atmospheric pressure when the motive pressure exceeds 192 kPa absolute, and the maximum vacuum is produced with a motive pressure of less than 135 kPa absolute. However, boosted engines routinely operate at above 135 kPa absolutes, so there is a need to improve the performance of an ejector on such a vehicle. These conventional ejectors are limited in the vacuum they can produce, in part because the different boost pressures cause the location of minimum pressure to move to different locations inside the ejector. Specifically, as the motive pressure increases beyond a certain value relative to the discharge pressure, the point of minimum vacuum creation moves progressively down the discharge passage.

What is needed is an ejector that can produce vacuum over a range of motive pressures.

SUMMARY

In one aspect, Venturi devices are disclosed that produce vacuum over a range of motive pressures by drawing suction at multiple locations along the discharge section. The Venturi devices include a lower body defining a passageway that has a motive section and a discharge section spaced a distance apart from one another to define a first Venturi gap and that converge toward the first Venturi gap, and that has a second Venturi gap downstream of the first Venturi gap at a position that divides the discharge section into a first portion between the first and second Venturi gaps and a second portion leading away from the second Venturi gap. The Venturi devices also include an upper body defining a suction passageway in fluid communication with both the first and second Venturi gaps. In one embodiment, the first Venturi gap and the second Venturi gap have a center to center distance of about 12 mm to about 50 mm.

In one embodiment, the first Venturi gap is generally wider at a top point, when viewed in a longitudinal cross-section, than at a generally central point. In another embodiment, the first Venturi gap is generally wider at a top point and a bottom point, when viewed in a longitudinal cross-section, than at a generally central point between the top point and the bottom point. In this embodiment, the lower body defines a first connector surrounding the bottom point of the Venturi gap and has a first cap sealingly connected to the first connector.

In one embodiment, the lower body and upper body, together, define a first check valve chamber in fluid communication with the first Venturi gap, the first check valve chamber comprising a plurality of fingers extending upward away from the first Venturi gap in a spaced-apart annular arrangement, thereby defining a seat for a sealing member. The upper body defines one or more openings into the first check valve chamber and the first Venturi gap is offset, downstream from the one or more openings. In this embodiment, the plurality of fingers decrease in height the more proximate its position is to the first Venturi gap.

In another embodiment, the lower body and upper body, together, define a second check valve chamber in fluid communication with the second Venturi gap, the second check valve chamber comprising a plurality of fingers extending upward away from the second Venturi gap in a spaced-apart annular arrangement, thereby defining a seat for a sealing member. The upper body defines one or more openings into the second check valve chamber and the second Venturi gap is offset, upstream from the one or more openings. In this embodiment, the plurality of fingers decrease in height the more proximate its position is to the second Venturi gap.

In another aspect, systems are disclosed that include any one of the Venturi devices disclosed herein. The Venturi device is disposed in the system with a source of motive fluid connected to the motive section thereof, and a first device requiring vacuum connected to the suction port thereof.

DETAILED DESCRIPTION

Figure 1:
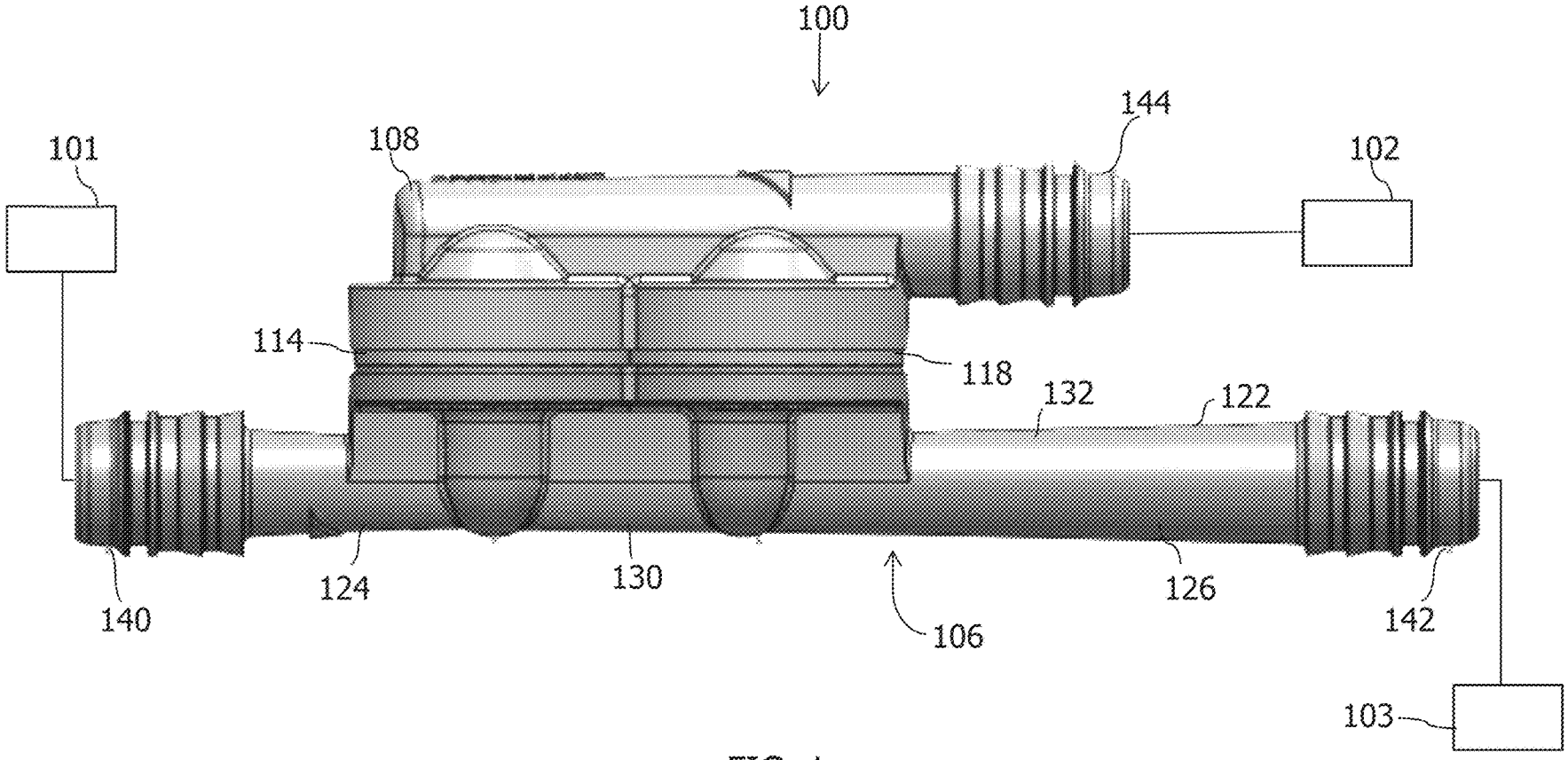
FIG. 1 is a side plan view of an embodiment of a multi-Venturi device.

The following detailed description will illustrate the general principles of the invention, examples of which are additionally illustrated in the accompanying drawings. In the drawings, like reference numbers indicate identical or functionally similar elements.

As used herein, "fluid" means any liquid, suspension, colloid, gas, plasma, or combinations thereof.

In FIG. 1, a multi-Venturi ejector 100 is depicted that includes a lower body 106 and an upper body portion 108 that when assembled together define a first check valve 114 aligned with a first Venturi gap 112 in the lower body 106 and a second check valve 118 aligned with a second Venturi gap 116 in the lower body 106. The first and second check valves 114, 118 may be constructed or have similar features to those described in co-assigned, co-pending patent application Ser. No. 14/600,598, filed Jan. 20, 2015 and Ser. No. 14/509,612, filed Oct. 8, 2014, which are each incorporated herein by reference in their entirety.

Figure 2:
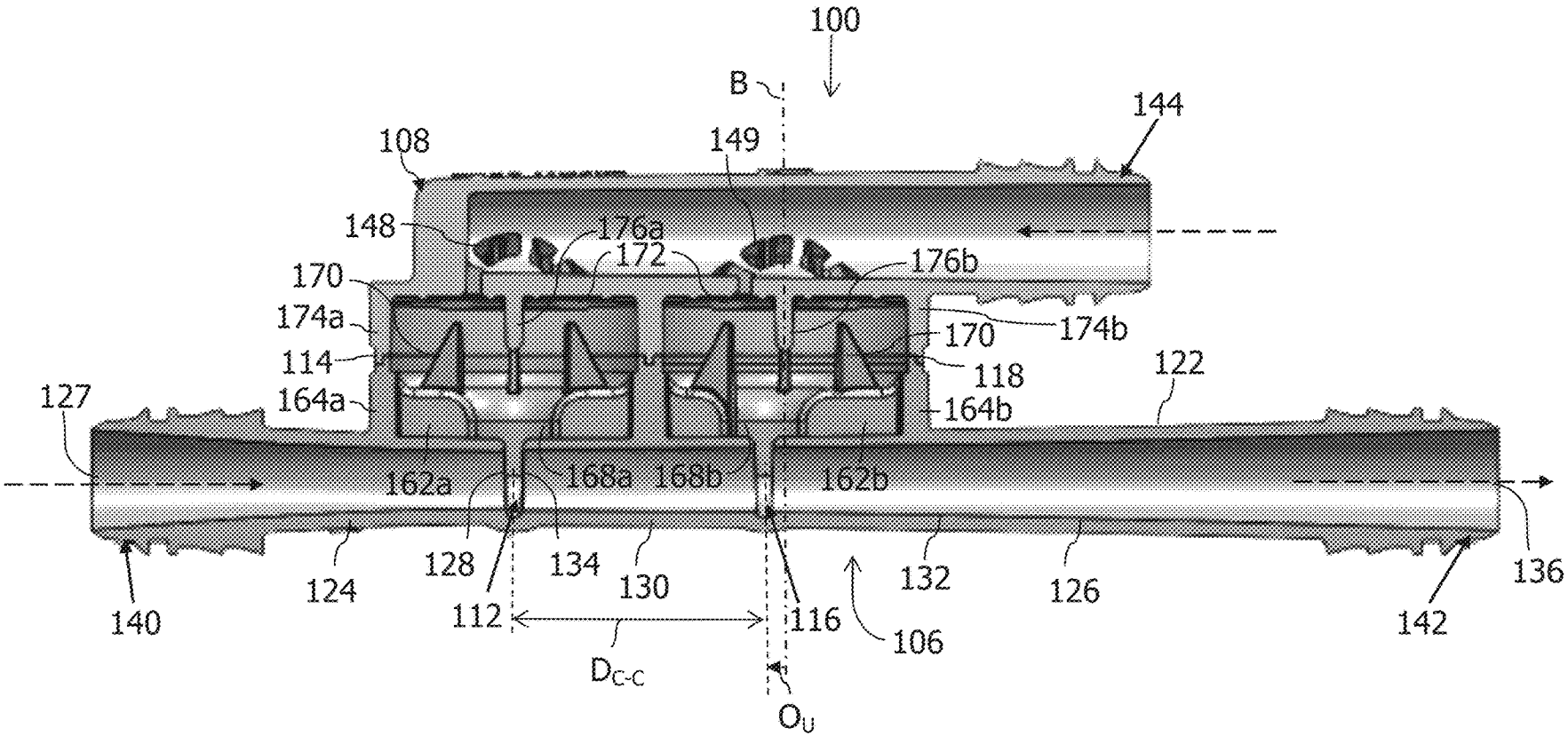
FIG. 2 is a longitudinal cross-sectional plan view of the multi-Venturi device of FIG. 1.

Now referring to FIGS. 1 and 2, the lower body 106 defines a conduit 122 that includes a first Venturi gap 112 separating the conduit 122 into a converging section 124 and a diverging section 126 that both define continuously, gradually tapering inner passageways that narrow as they approach the first Venturi gap 112 and create a Venturi effect on the high pressure fluid as it passes from the converging section 124 into the diverging section 126. The lower body 106 also includes a second Venturi gap 116, which is downstream of the first Venturi gap 112 at a position that separates the diverging section 126 into a first portion 130 that is between the first and second Venturi gaps 112, 116 and includes the discharge inlet 134 (FIG. 2) and into a second portion 132 that leads away from the second Venturi gap 116 to the discharge outlet 136 (FIG. 2) defined by the discharge port 142. The converging section 124 includes a motive port 140 that defines a motive inlet 127, which may be connected to a source of pressure that is greater than atmospheric pressure, and includes a motive outlet 128 at the first Venturi gap 112. The discharge port 142 is connectable to a source of lower pressure 103 relative to the source connected to the motive port 140.

As depicted in FIG. 2, the upper body 108 defines a suction port 144 having a suction passageway 146 and defining one or more first openings 148 therein in fluid communication with the first check valve 114 and the first Venturi gap 112 and one or more second openings 149 therein in fluid communication with the second check valve 118 and the second Venturi gap 116. Accordingly, as high pressure fluid flows from a source of higher pressure 101 through the first Venturi gap 112, suction is created to draw a flow of fluid from the suction port 144 into the first Venturi gap 112 and as the high pressure fluid and the suction flow both pass through the second Venturi gap 116, additional suction is created to draw a flow of fluid from the suction port 144 through the second Venturi gap 116. The suction port 144 may be connected to a device requiring vacuum 102 to operate the device or may be connected to a vacuum reservoir, which is considered herein to be a device requiring vacuum.

The first and second check valves 114, 118 are constructed to prevent fluid from flowing from the lower body 106 of the multi-Venturi ejector 100 through the suction port 144 to the device requiring vacuum or the vacuum reservoir. The check valves 114, 118 are preferably formed by the mating of the lower body 106 with the upper body 108. To accomplish this, the lower body includes valve seats 162*a*, 162*b* that are respectively defined by a continuous outer wall 164*a*, 164*b*. A bore 168*a*, 168*b* is defined in each valve seat 162*a*, 162*b* to allow for air flow communication with respective Venturi gaps 112, 116. Each valve seat 162*a*, 162*b* may include a plurality of radially spaced-apart fingers 170 extending upward from a surface thereof (away from the Venturi gap) to support a seal member 172.

The upper body 108 includes valve seats 174*a*, 174*b* defined by continuous outer walls in a manner similar to that described above with respect to valve seats 162*a*, 162*b*. Valve seats 174*a*, 174*b* may each include a pin 176*a*, 176*b* extending downward toward the associated Venturi gap 112, 116. The pins 176*a*, 176*b* function as a guide for translation of the sealing members 172 within the check valves 114, 118. Accordingly, each sealing member 172 includes a bore therethrough sized and positioned for receipt of the pin 176*a*, 176*b* within its respective check valve 114, 118.

The second Venturi gap 116 may be shaped and sized the same as the first Venturi gap 112 or may be substantially the same. The first Venturi gap 112 and the second Venturi gap 116 have a center to center distance in the range of about 12 mm to about 50 mm, more preferably in the range of about 15 mm to about 30 mm.

The Venturi device of FIGS. 1 and 2 has a first Venturi gap 112 and a second Venturi gap 116 that are both generally wider at a top point, when viewed in the longitudinal cross-section of FIG. 2, than at a generally central point.

As shown in FIG. 2, the second Venturi gap 116 may be offset upstream $O_u$ from a generally central point of the one or more second openings 149 in the upper body 108 or from a plane coincident with a transverse axis B through generally the center of the second check valve 118.

Referring now to the embodiment in FIGS. 3-6, a multi-Venturi device 200 is depicted that includes a lower body 206 and an upper body 208 that, when assembled together, define a first check valve 214 aligned with a first Venturi gap 212 in the lower body 206 and a second check valve 218 aligned with a second Venturi gap 216 in the lower body 206. The lower body 206 defines a conduit 222 that includes a first Venturi gap 212 separating the conduit 222 into a converging section 224 and a diverging section 226 that both define continuously, gradually tapering inner passageways that narrow as they approach the first Venturi gap 212 and create a Venturi effect on fluid as it passes from the converging section 224 into the diverging section 226. The lower body 206 also includes a second Venturi gap 216, which is downstream of the first Venturi gap 212 at a position that separates the diverging section 226 into a first portion 230 that is between the first and second Venturi gaps 212, 216 and includes the discharge inlet 234 (FIG. 4) and into a second portion 232 that leads away from the second Venturi gap 216 to the discharge outlet 236 (FIG. 4) defined by the discharge port 242. The converging section 224 includes a motive port 240 that defines a motive inlet 227, which is connectable to a source of pressure, and includes a motive outlet 228 at the first Venturi gap 212. The discharge port 242 is connectable to a source of lower pressure relative to the source connected to the motive port 240.

Figure 4:
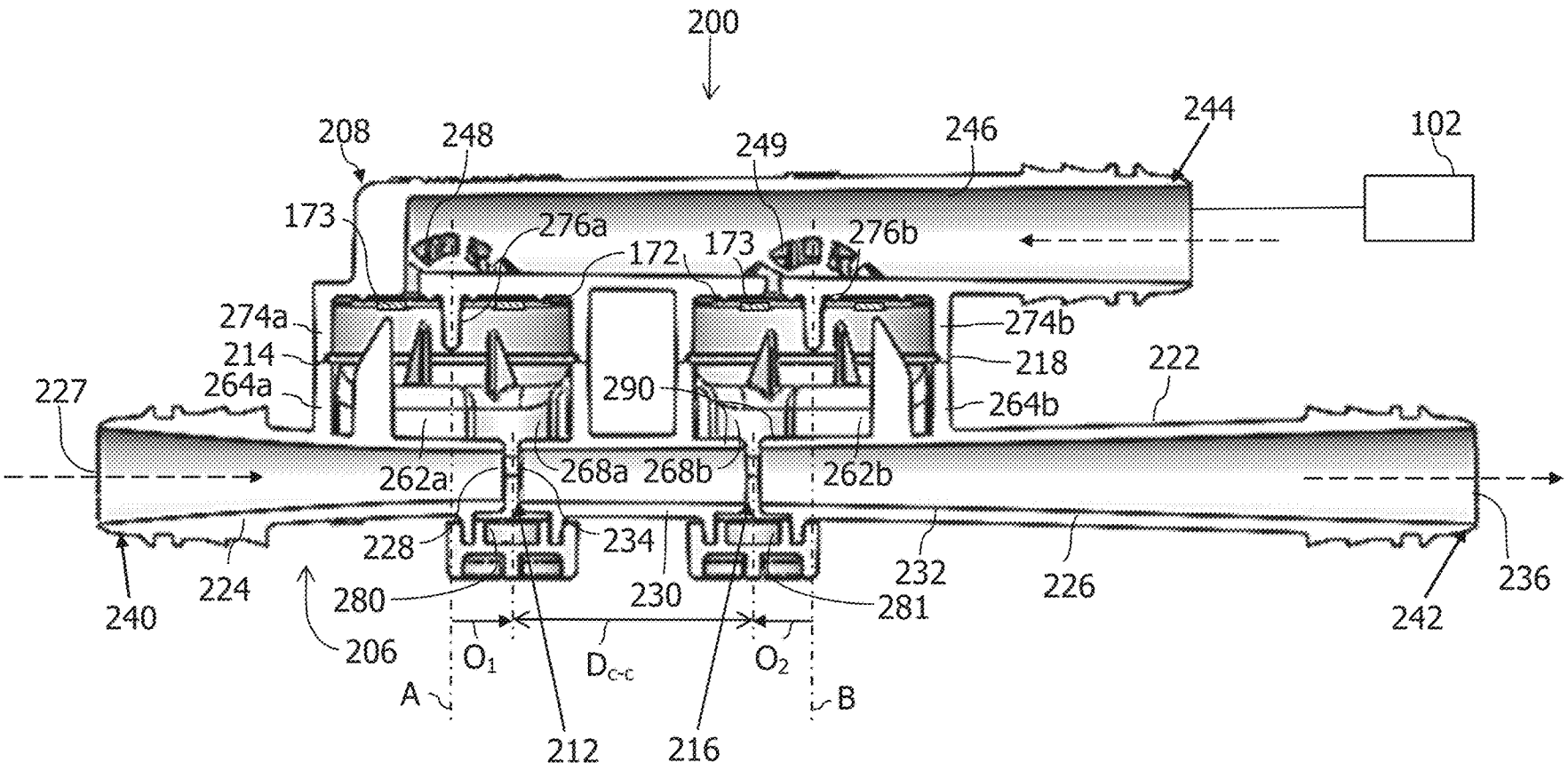
FIG. 4 is an assembled, longitudinal cross-sectional plan view of the multi-Venturi device of FIG. 3.

As depicted in FIG. 4, the upper body 208 defines a suction port 244 having a suction passageway 246 and defining one or more first openings 248 therein in fluid communication with the first check valve 214 and the first Venturi gap 212 and one or more second openings 249 therein in fluid communication with the second check valve 218 and the second Venturi gap 216. Accordingly, as fluid flows through the first Venturi gap 212, suction is created to draw a flow of fluid from the suction port 244 into the first Venturi gap 212, and as the fluid and the suction flow both pass through the second Venturi gap 216, additional suction is created to draw a flow of fluid from the suction port 244 through the second Venturi gap 216. The suction port 244 may be connected to a device requiring vacuum to operate the device or may be connected to a vacuum reservoir. As illustrated, the first Venturi gap 212 may be offset $O_1$ from a generally central point of the one or more first openings 148 in the downstream direction toward the second Venturi gap 216, and the second Venturi gap 216 may be offset upstream $O_2$ from a generally central point of the one or more second openings 249 in the upper body 208 or from a plane coincident with a transverse axis through generally, for both Venturi gaps, the center of the respective check valve.

The second Venturi gap 216 may be shaped and sized the same as the first Venturi gap 212 or may be substantially the same. The first Venturi gap 212 and the second Venturi gap 216 have a center to center distance $D_{c\text{-}e}$, in the range of about 12 mm to about 50 mm, more preferably in the range of about 15 mm to about 30 mm.

The first and second check valves 214, 218 are constructed to prevent fluid from flowing from the lower body 206 of the multi-Venturi ejector 200 through the suction port 244 to the device requiring vacuum or the vacuum reservoir. The check valves 214, 218 are preferably formed by the mating of the lower body 206 with the upper body 208. To accomplish this, the lower body includes valve seats 262*a*, 262*b* that are respectively defined by a continuous outer wall 264*a*, 264*b*. A bore 268*a*, 268*b* is defined in each valve seat 262*a*, 262*b* to allow for air flow communication with respective Venturi gaps 212, 216.

The upper body 208 includes valve seats 274*a*, 274*b* defined by continuous outer walls in a manner similar to that described above with respect to valve seats 262*a*, 262*b*. Valve seats 274*a*, 274*b* may each include a pin 276*a*, 276*b* extending downward toward the associated Venturi gap 212, 216. The pins 276*a*, 276*b* function as a guide for translation of the sealing members 172 within the check valves 214, 218. Accordingly, each sealing member 172 includes a bore therethrough sized and positioned for receipt of the pin 276*a*, 276*b* within its respective check valve 214, 218.

Figure 5:
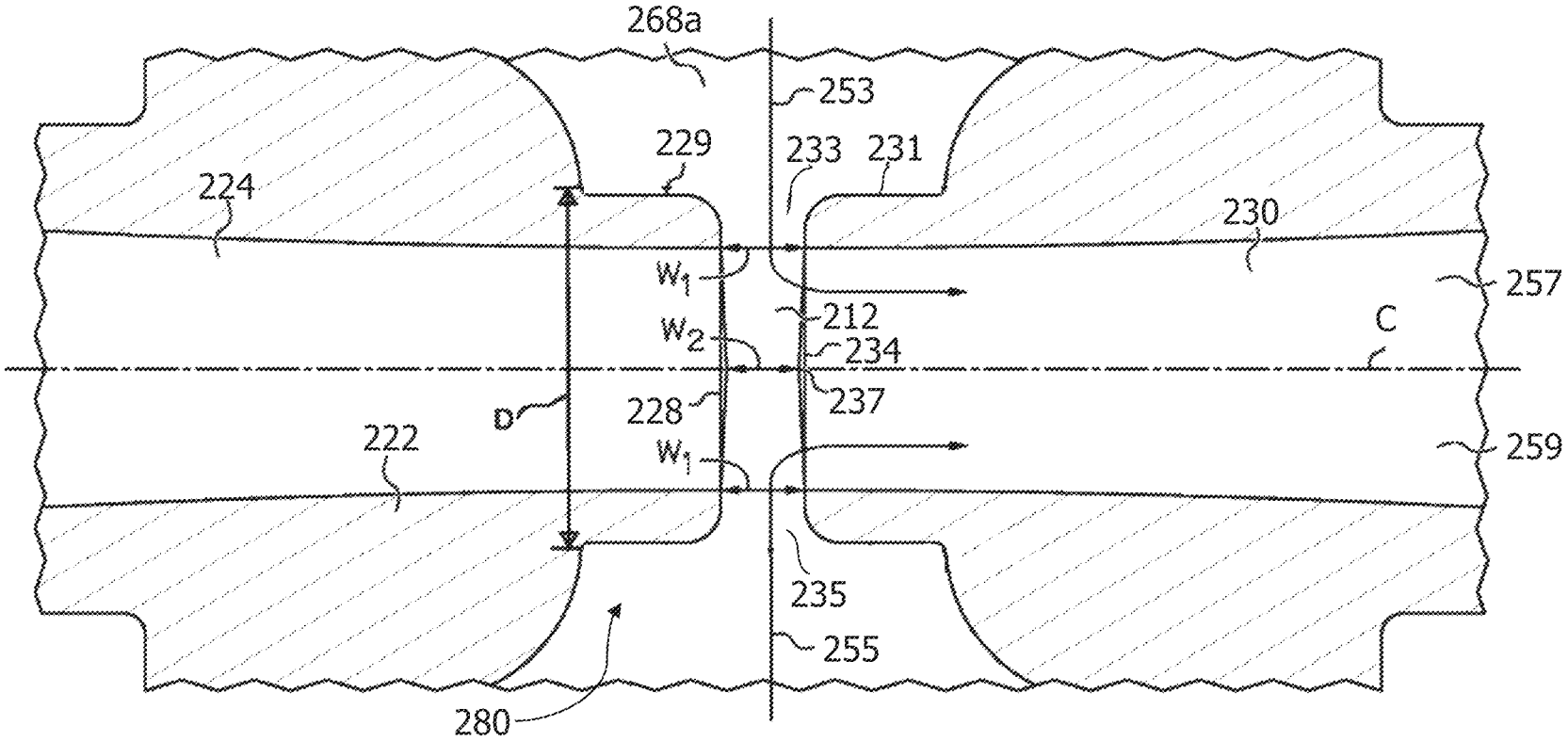
FIG. 5 is an enlarged view of the first Venturi gap of FIG. 4.

As shown in the enlarged view in FIG. 5, any of the Venturi gaps disclosed herein, with particular reference to the first Venturi gap 212 in FIG. 4, are generally wider at a top point 233 and at a bottom point 235, when viewed in a longitudinal cross-section, than at a generally central point 237 aligned with the central longitudinal axis C between the top point 233 and the bottom point 235. The width of the Venturi gap 212 tapers symmetrically from a maximum width $W_1$ at the upper and lower ends, respectively, of the gap to a minimum width $W_2$ at the center point 237. As a result, the void defined by the Venturi gap 212 is symmetrical about a plane bisecting the conduit 222 into upper and lower halves 257, 259 (in the illustrated embodiment, above and below axis C), thereby improving flow conditions and decreasing turbulence and resultant noise as fluid flows through the Venturi gap 212 as compared to aspirator systems incorporating Venturi gaps with asymmetrical (e.g., conical or tapered) configurations.

With reference to FIGS. 4 and 5, the lower body 206 defines a first chamber 280 that surrounds the motive outlet end 229 of the converging (motive) section 224, surrounds the discharge inlet end 231 of the diverging (discharge) section 226, and includes or begins with the bore 268*a*. With the motive outlet end 229 and the discharge inlet end 231 extending into the first chamber 280, fluid flow is provided around the entire outer surface of both thereof. The lower body 206 further defines a first connector 286 (FIG. 3) surrounding the bottom point 235 (FIG. 5) of the first Venturi gap 212 and further comprises a first cap 292 sealingly connected to the first connector 286, thereby helping to define the first chamber 280. The first connector 286 may be an annular flange protruding outward from the lower body 206, but is not limited thereto. The lower body 206 also defines a second chamber 281 for the second Venturi gap 218. The second chamber 281 surrounds the two opposing ends 290 of the discharge section formed by the formation of the second Venturi gap 216. The two opposing ends 290 extend into the second chamber 281 such that fluid flow is provided around the entire outer surface of both thereof. Here, too, the lower body 206 further defines a second connector 288, which may be an annular flange protruding outward from the lower body 206, surrounding a bottom point of the second Venturi gap 216. A second cap 294 is sealingly connected to the second connector 288, thereby helping to define the second chamber 281.

The disclosed structure, incorporating fluid flow into both of the first Venturi gap 212 and the second Venturi gap 216 from above and below the Venturi gaps, as well as all sides thereof, provides improved suction flow rate for a given motive flow and discharge pressure as compared to a system incorporating less directions of flow into the Venturi gap because the disclosed system provides greater capacity to utilize the Venturi effect created by the motive flow through the conduit 222. With reference to FIG. 5, arrows 253 and 255 indicate the fluid flow path through the upper and lower points 233, 235 of the Venturi gap 212. Venturi forces generated by the motive flow through the upper half 257 of the conduit 222 across the Venturi gap 212 yield suction primarily along flow path 253 through the bore 268*a*. Venturi forces generated by the motive flow through the lower half 259 of the conduit 222 across the Venturi gap 212 yield suction primarily along flow path 255.

Figure 3:
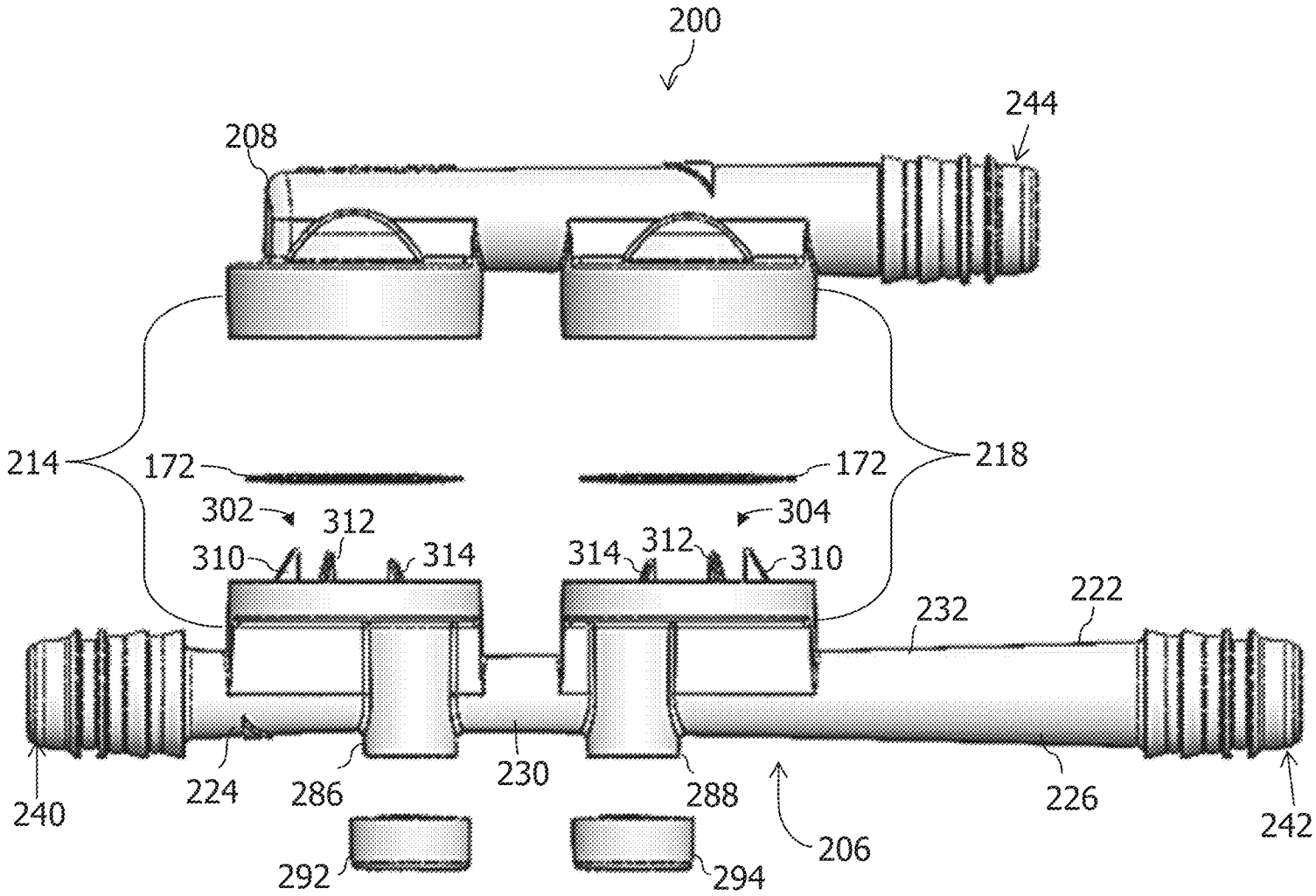
FIG. 3 is an exploded, side plan view of a second embodiment of a multi-Venturi device.
Figure 6:
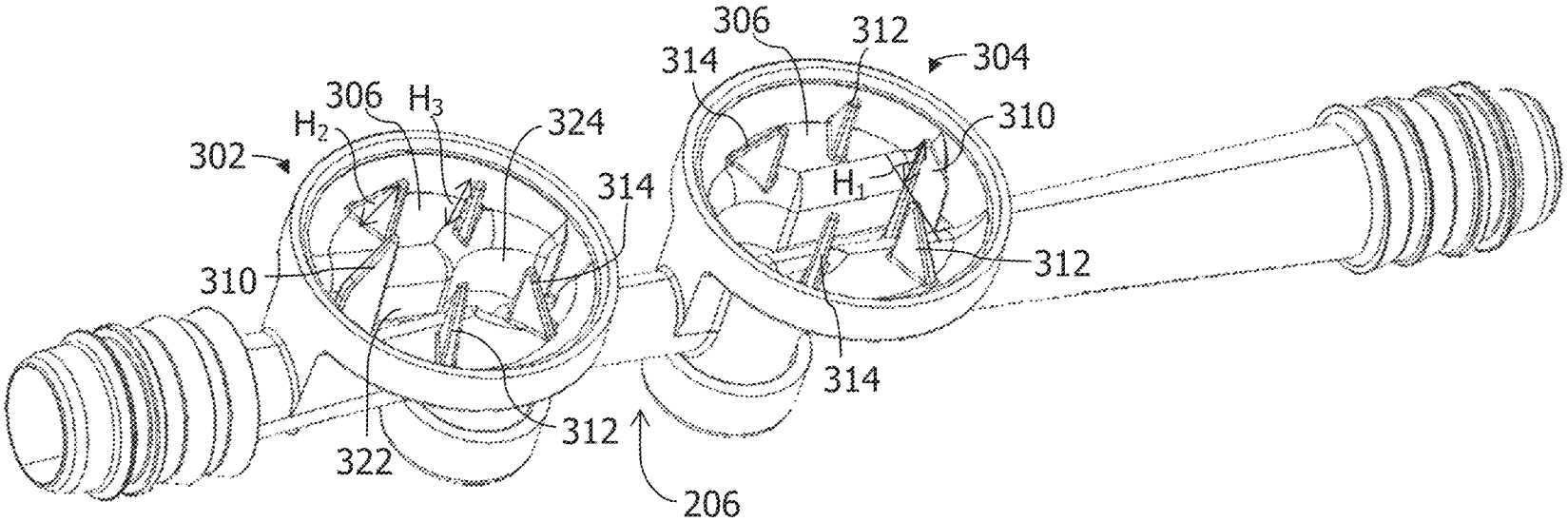
FIG. 6 is a perspective, top view into the lower body of the multi-Venturi device of FIG. 3.

Referring to FIGS. 3-4 and 6, the lower body 206 further defines a first plurality of fingers 302 extending upward away from the first Venturi gap 212 toward the upper body 208 for inclusion inside the first check valve 214 and a second plurality of fingers 304 extending upward away from the second Venturi gap 216 toward the upper body 208 for inclusion inside the second check valve 218. The first plurality of fingers 302 and the second plurality of fingers 304 both define, separately, a seat for a sealing member 172. Both of the first and second plurality of fingers 302, 304 may be arranged in an annular configuration with the fingers circumferentially spaced apart from one another. The plurality of fingers may be equidistant apart from one another, except for the pair of third fingers 314, which may be farther apart from one another because of their proximity to one of the bores 268*a*, 268*b*.

The bores 268*a*, 268*b* may be irregularly shaped, may be generally circular in cross-section, or may include a portion that is generally circular in cross-section. As illustrated in FIG. 6, each of the bores 268*a*, 268*b* include a trough portion 322 and a portion that is generally circular in cross-section 324. As shown in the exemplary embodiment, each of the first and second plurality of fingers 302, 304 may include discrete fingers that decrease in height the more proximate the particular discrete finger is to its respective Venturi gap 212, 216. For instance, first finger 310 has the greatest height $H_1$, measured from a plane coincident with an interior bottom surface 306 of the respective check valve unit 214, 218, and is circumferentially the farthest from the Venturi gap. The second fingers 312 are shorter than the first finger 310 and have a height $H_2$. The third fingers 314 are shorter than the second fingers 312 and have a height $H_3$. The height $H_2$ of the second fingers 312 may be about 70% to about 90% of the total height of the first finger 310, and the third fingers may be about 70% to about 90% of the height of the second fingers 312. With this type of support structure defining a seat for the seal member 172, the seal member 172 deflects sufficiently to permit high bypass flow of fluid from the device requiring vacuum 102 when the pressure in the device requiring vacuum 102 is greater than a pressure of fluid coupled to the discharge port 224 and also provides for quick, more uniform closure of each of the check valves. While three discrete heights of fingers are illustrated, more fingers could be used to define the seat for the seal member 172 and, as such, appropriate heights thereof may be introduced to have the overall height decrease as the fingers are positioned more proximate the Venturi gap. In the embodiment of FIGS. 3-6, referring to one of the sets of plurality of fingers as an example, the first finger 310 is the tallest, the second fingers 312 are about 1 mm shorter than the first finger, and the third fingers are about 2 mm shorter than the first finger (about 1 mm shorter than the second fingers).

In both embodiments disclosed in the figures, the sealing members 172 may be reinforced for improved performance. The sealing member 172 includes a reinforcing member 173 as shown in FIG. 4. The sealing members 172 have a generally central bore receiving pin 176*a*, 176*b* or 276*a*, 276*b*, respectively, but is not limited thereto. In another embodiment (not shown), one or more guides may be positioned about the periphery of the sealing member and the sealing member may or may not include fluting that receives the guides. The reinforcing member 173 may be over-molded at least partially by a sealing material, or encased within a sealing material. The reinforcing member 173 enables the sealing members 172 to withstand extruding between the plurality of spaced-apart fingers 170 (FIG. 2) and 302, 304 (FIG. 3-4) when a high change in pressure is experienced. In one embodiment, the reinforcing member 173 is or includes metal having a rigidity enabling the sealing member 172 to withstand extruding between the fingers as just explained. As used herein, "metal" is used generically to represent all materials that may be pure metal, metal alloys, metal composites, and combination thereof having a suitable rigidity. In another embodiment, the reinforcing member 173 may be carbon fiber or plastics such as nylon or acetyl with or without fill (typically 30% by volume) such as glass, mineral, and the like. Additional details of exemplary embodiments of reinforced sealing members are found in co-assigned, U.S. application Ser. No. 14/600,598, filed Jan. 20, 2015.

One advantage of the multi-Venturi ejector is that the ejector can produce a useable vacuum over a wider range of fluid flow pressures (for example, boost pressures) compared to ejectors having only a single Venturi gap.

In one embodiment, the multi-Venturi ejector may include a noise attenuating unit (not shown) that is the same or similar to the unit described in co-pending patent application No. 61/913,756, filed Dec. 9, 2013, incorporated herein in its entirety.

What is claimed is:

1. A Venturi device comprising: a lower body defining a passageway having a motive section and a discharge section spaced a distance apart from one another to define a first Venturi gap, the motive section and the discharge section converge toward the first Venturi gap, and having a second Venturi gap downstream of the first Venturi gap at a position within a diverging section that divides a diverging section of the discharge section into a first diverging portion between the first and second Venturi gaps spaced a distance apart from a second diverging portion beginning at the second Venturi gap and diverging away from the second Venturi gap; an upper body defining a suction passageway in fluid communication with both the first and second Venturi gaps; a first check valve defined by the lower body and the upper body and housing a sealing member, wherein the first check valve has a plane coincident with a transverse axis (A) through the center of the first check valve and controls fluid flow through the first Venturi gap; and a second check valve defined by the lower body and the upper body and housing a sealing member, wherein the second check valve has a plane coincident with a transverse axis (B) through the center of the second check valve and controls fluid flow through the second Venturi gap; wherein the second Venturi gap is offset upstream within the second check valve relative to the plane coincident with the transverse axis (B) of the second check valve; wherein as high pressure fluid flows through the first Venturi gap, suction is created to draw a flow of fluid from the suction passageway into the first Venturi gap, and as the high pressure fluid and suction flow both pass through the second Venturi gap additional suction is created to draw a flow of fluid from the suction passageway through the second Venturi gap.

2. The Venturi device of claim 1, wherein the first Venturi gap and the second Venturi gap have a center to center distance of 12 mm to 50 mm.

3. The Venturi device of claim 2, wherein the first Venturi gap is offset downstream within the first check valve relative to a plane coincident with the transverse axis (A).

4. The Venturi device of claim 1, wherein the first Venturi gap is wider at a top point, when viewed in a longitudinal cross-section, than at a central point.

5. The Venturi device of claim 1, wherein the first Venturi gap is defined by an end face of an outlet end of the motive section and an end face of the inlet end of the discharge section and both end faces taper from a top point and a bottom point, when viewed in a longitudinal cross-section, to a central point between the top point and the bottom point, thereby the first Venturi gap has a width that tapers symmetrically from a maximum width $W_1$ at the top point and the bottom point of the first Venturi gap to a minimum width $W_2$ at a center point therebetween.

6. The Venturi device of claim 5, wherein the lower body defines a first connector surrounding the bottom point of the first Venturi gap and further comprises a first cap sealingly connected to the first connector.

7. The Venturi device of claim 1, wherein the lower body and upper body, together, define a first check valve chamber in fluid communication with the first Venturi gap, the first check valve chamber comprising a plurality of fingers extending upward away from the first Venturi gap in a spaced-apart annular arrangement, thereby defining a seat for a sealing member.

8. The Venturi device of claim 7, wherein the upper body defines one or more openings into the first check valve chamber and the first Venturi gap is offset, downstream from the one or more openings.

9. The Venturi device of claim 8, wherein the plurality of fingers decrease in height the more proximate to the first Venturi gap.

10. The Venturi device of claim 1, wherein the lower body and upper body, together, define a second check valve chamber in fluid communication with the second Venturi gap, the second check valve chamber comprising a plurality of fingers extending upward away from the second Venturi gap in a spaced-apart annular arrangement, thereby defining a seat for a sealing member.

11. The Venturi device of claim 10, wherein the upper body defines one or more openings into the second check valve chamber and the second Venturi gap is offset, upstream from the one or more openings.

12. The Venturi device of claim 11, wherein the plurality of fingers decrease in height the more proximate to the second Venturi gap.

13. The Venturi device of claim 1, wherein the second Venturi gap is shaped the same as the first Venturi gap.

14. A system comprising: a Venturi device comprising: a lower body defining a passageway having a motive section and a discharge section spaced a distance apart from one another to define a first Venturi gap, the motive section and the discharge section converge toward the first Venturi gap, and having a second Venturi gap downstream of the first Venturi gap at a position within a diverging section that divides a diverging section of the discharge section into a first diverging portion between the first and second Venturi gaps spaced a distance apart from a second diverging portion beginning at the second Venturi gap and diverging away from the second Venturi gap; and an upper body defining a suction passageway in fluid communication with both the first and second Venturi gaps; a first check valve defined by the lower body and the upper body and housing a sealing member, wherein the first check valve has a plane coincident with a transverse axis (A) through the center of the first check valve and controls fluid flow through the first Venturi gap, and a second check valve defined by the lower body and the upper body and housing a sealing member, wherein the second check valve has a plane coincident with a transverse axis (B) through the center of the second check valve and controls fluid flow through the second Venturi gap; wherein the second Venturi gap is offset upstream within the second check valve relative to the plane coincident with the transverse axis (B) of the second check valve: wherein as high pressure fluid flows through the first Venturi gap, suction is created to draw a flow of fluid from the suction passageway into the first Venturi gap, and as the high pressure fluid and suction flow both pass through the second Venturi gap additional suction is created to draw a flow of fluid from the suction passageway through the second Venturi gap a source of motive flow fluidly connected to the motive section of the Venturi device; and a first device requiring vacuum connected to the suction port of the Venturi device.

15. The system of claim 14, wherein the first Venturi gap and the second Venturi gap have a center to center distance of 12 mm to 50 mm.

16. The system of claim 14, wherein the lower body and upper body, together, define a first check valve chamber in fluid communication with the first Venturi gap, the first check valve chamber comprising a plurality of fingers extending upward away from the first Venturi gap in a spaced-apart annular arrangement, thereby defining a seat for a sealing member.

17. The system of claim 16, wherein the upper body defines one or more openings into the first check valve chamber and the first Venturi gap is offset, downstream from the one or more openings.

18. The system of claim 17, wherein the plurality of fingers decrease in height the more proximate to the first Venturi gap.

19. The system of claim 14, wherein the lower body and upper body, together, define a second check valve chamber in fluid communication with the second Venturi gap, the second check valve chamber comprising a plurality of fingers extending upward away from the second Venturi gap in a spaced-apart annular arrangement, thereby defining a seat for a sealing member.

20. The system of claim 19, wherein the upper body defines one or more openings into the second check valve chamber and the second Venturi gap is offset, upstream from the one or more openings.

21. The system of claim 20, wherein the plurality of fingers decrease in height the more proximate to the first Venturi gap.

22. A Venturi device comprising: a lower body defining a passageway having a motive section and a discharge section spaced a distance apart from one another to define a first Venturi gap, the motive section and the discharge section converge toward the first Venturi gap, and having a second Venturi gap downstream of the first Venturi gap at a position within a diverging section that divides a diverging section of the discharge section into a first diverging portion between the first and second Venturi gaps and a second diverging portion beginning at the second Venturi gap and diverging away from the second Venturi gap; an upper body defining a suction passageway in fluid communication with both the first and second Venturi gaps; a first check valve defined by the lower body and the upper body and housing a sealing member, the first check valve controlling fluid flow through the first Venturi gap; and a second check valve defined by the lower body and the upper body and housing a sealing member, the second check valve controlling fluid flow through the second Venturi gap; wherein as high pressure fluid flows through the first Venturi gap, suction is created to draw a flow of fluid from the suction passageway into the first Venturi gap, and as the high pressure fluid and suction flow both pass through the second Venturi gap additional suction is created to draw a flow of fluid from the suction passageway through the second Venturi gap; wherein the first Venturi gap is defined by an end face of an outlet end of the motive section and an end face of the inlet end of the discharge section and both end faces taper from a top point and a bottom point, when viewed in a longitudinal cross-section, to a central point between the top point and the bottom point, thereby the first Venturi gap has a width that tapers symmetrically from a maximum width Wi at the top point and the bottom point of the first Venturi gap to a minimum width W2 at a center point therebetween.

23. A Venturi device comprising:

a lower body defining a passageway having a motive section and a discharge section spaced a distance apart from one another to define a first Venturi gap, the motive section and the discharge section converge toward the first Venturi gap, and having a second Venturi gap downstream of the first Venturi gap at a position within a diverging section that divides the diverging section of the discharge section into a first diverging portion between the first and second Venturi gaps spaced a distance apart from a second diverging portion beginning at the second Venturi gap and diverging away from the second Venturi gap, and defining a first connector surrounding a bottom point of the first Venturi gap and a second connector surrounding a bottom of the second Venturi gap;

an upper body defining a suction passageway in fluid communication with both the first and second Venturi gaps;

a first check valve defined by the lower body and the upper body and housing a sealing member, the first check valve controlling fluid flow through the first Venturi gap;

a second check valve defined by the lower body and the upper body and housing a sealing member, the second check valve controlling fluid flow through the second Venturi gap; and a first cap sealingly connected to the first connector and a second cap sealingly connected to the second connector;

wherein as high pressure fluid flows through the first Venturi gap, suction is created to draw a flow of fluid from the suction passageway into the first Venturi gap, and as the high pressure fluid and suction flow both pass through the second Venturi gap additional suction is created to draw a flow of fluid from the suction passageway through the second Venturi gap.

* * * * *